US009377267B1

(12) United States Patent
Kempf

(10) Patent No.: US 9,377,267 B1
(45) Date of Patent: Jun. 28, 2016

(54) SHOOTING BOW WITH TRANSITIONAL MODULES

(71) Applicant: James J. Kempf, Coralville, IA (US)

(72) Inventor: James J. Kempf, Coralville, IA (US)

( * ) Notice: Subject to any disclaimer, the term of this patent is extended or adjusted under 35 U.S.C. 154(b) by 1 day.

(21) Appl. No.: 14/558,827

(22) Filed: Dec. 3, 2014

(51) Int. Cl.
*F41B 5/10* (2006.01)
*F41B 5/12* (2006.01)

(52) U.S. Cl.
CPC . *F41B 5/105* (2013.01); *F41B 5/10* (2013.01); *F41B 5/12* (2013.01); *F41B 5/123* (2013.01); *Y10S 124/90* (2013.01)

(58) Field of Classification Search
CPC ..... F41B 5/10; F41B 5/105; F41B 5/12; F41B 5/123; Y10S 124/90
USPC ..... 124/25, 25.6, 900
See application file for complete search history.

(56) References Cited

U.S. PATENT DOCUMENTS 4,338,910 A * 7/1982 Darlington ..... F41B 5/10 124/25.6
4,340,025 A * 7/1982 Caldwell ..... F41B 5/105 124/23.1
4,515,142 A * 5/1985 Nurney ..... F41B 5/10 124/25.6
4,649,890 A * 3/1987 Powers ..... F41B 5/105 124/25.6
4,649,891 A * 3/1987 Bozek ..... F41B 5/123 124/25
4,756,296 A * 7/1988 Darlington ..... F41B 5/10 124/25.6
4,917,071 A * 4/1990 Bozek ..... F41B 5/12 124/24.1
5,678,528 A * 10/1997 Hadley ..... F41B 5/12 124/24.1
6,776,148 B1 * 8/2004 Islas ..... F41B 5/10 124/25.6
6,792,931 B1 * 9/2004 Schaar ..... F41B 5/10 124/25.6
6,990,970 B1 * 1/2006 Darlington ..... F41B 5/10 124/25.6
7,047,958 B1 * 5/2006 Colley ..... F41B 5/105 124/25.6
7,578,289 B2 * 8/2009 Norkus ..... F41B 5/0094 124/25
7,637,256 B2 * 12/2009 Lee ..... F41B 5/105 124/25.6
7,823,572 B2 * 11/2010 Anderson ..... F41B 5/123 124/25
7,891,348 B2 * 2/2011 Colley ..... F41B 5/105 124/25
7,971,582 B1 * 7/2011 Larson ..... F41B 5/10 124/25.6
8,037,876 B1 * 10/2011 Yehle ..... F41B 5/10 124/25.6
8,387,603 B2 * 3/2013 Darlington ..... F41B 5/10 124/23.1
8,522,762 B2 * 9/2013 Trpkovski ..... F41B 5/0094 124/23.1
8,651,095 B2 * 2/2014 Islas ..... F41B 5/105 124/25
8,826,894 B1 * 9/2014 Darlington ..... F41B 5/105 124/25
8,833,349 B2 * 9/2014 Park ..... F41B 5/0094 124/25.6
8,899,217 B2 * 12/2014 Islas ..... F41B 5/105 124/25.6
8,919,332 B2 * 12/2014 Trpkovski ..... F41B 5/0094 124/23.1
8,997,728 B2 * 4/2015 Popov ..... F41B 5/0094 124/25.6
9,234,719 B1 * 1/2016 Kempf ..... F41B 5/105
9,243,861 B1 * 1/2016 Kempf ..... F41B 5/12
9,297,604 B1 * 3/2016 Sidebottom ..... F41B 5/123
2011/0041820 A1 * 2/2011 Stanziale ..... F41B 5/105 124/25
2012/0125302 A1 * 5/2012 Stanziale ..... F41B 5/123 124/25
2014/0261360 A1 * 9/2014 Pulkrabek ..... F41B 5/1469 124/35.2
2015/0285581 A1 * 10/2015 Chang ..... F41B 5/105 124/25

* cited by examiner

*Primary Examiner* — Alexander Niconovich
(74) *Attorney, Agent, or Firm* — Donald J. Ersler

(57) ABSTRACT

A shooting bow with transition modules includes two string cams, two cables, a bow string, two limbs and a bow riser. The shooting bow may be a cross bow or a vertical bow. The first and second limbs extend from each end of the bow riser. The first and second cams are pivotally retained on the first and second limbs. The first and second cams retain a bowstring. The first and second cams retain the first and second cables. Each cam includes a cam ring, a cam hub and a transition module. The bow string is retained on cam ring. The cam hub includes an upper track, which continues to a lower track. The transition module includes a cable track. The cam hubs and the transition modules allow the cams to be rotated as much as 330 degrees.

17 Claims, 18 Drawing Sheets

SHOOTING BOW WITH TRANSITIONAL MODULES

BACKGROUND OF THE INVENTION

1. Field of the Invention

The present invention relates generally to archery and more specifically to a shooting bow with transitional modules, where a power cable track is at least partially angled to allow a cable to pass above itself, thus a power section of a cable transitions to a control section of a cable as the cam rotates.

2. Discussion of the Prior Art

Historically, archery bows and crossbows have been used for war, survival, sport, and recreation. A specific component of a compound style shooting bow are the cables. Each cable includes a power end and a control end. The manner in which the cables interact with the cams and limbs of the bow is of particular importance. Typically, the power end of the cable is coupled to the cam on one limb, and the control end of the cable is often coupled to the opposite limb or opposite cam. A very good way to accomplish efficiency is through a binary cam system, wherein the cables are connected to opposing cams, and as one of the cams wraps the cable on the power track, the opposite cam pays out cable from the control track. While all of these methods work to some extent, all have significant issues with performance and/or assembly and cost. One of the main drawbacks to conventional binary cam systems is the inability of the cam system to rotate beyond about 180 to 200 degrees. This restriction requires an ever increasing diameter of the cam as power stroke of the bow increases, which in turn ads to the weight of the cam. As the weight of the cam increases, efficiency decreases.

U.S. Pat. No. 4,338,910 Darlington shows a cam with an angled or cross-over groove, and U.S. Pat. No. 6,990,970 Darlington shows a binary style cam. Other binary cam designs have been patented as well, but all binary designs have the limitation of minimal rotation, caused by the control end of the cable reaching a point in rotation as to not allow the cam to rotate any further without "locking up".

The above inventions are trying to keep cables in proper timing, and there is no provision for the payout cable to wrap onto any power-generating track of the cam. By not allowing the cams to rotate more without locking, all prior binary cams have less than desirable limitations The present invention deals with the manner in which the cables are coupled to the cams, a transitional module that allows the control end of a cable to transition into a power generating end of a cable, and how said cables wrap the cable tracks and create power in the bow or crossbow. It appears that the prior art does not disclose string cams that rotate more than 180 degrees.

Accordingly, there is a clearly felt need in the art to provide a shooting bow with transitional modules, which allows a power end of first and second cables to be coupled to first and second cams and a control end of the cable to be coupled back to the first and second cams, which in turn allows the cams to rotate as much as 330 degrees.

SUMMARY OF THE INVENTION

The present invention provides a shooting bow with transitional modules, which allows a power end of first and second cables to be coupled to first and second cams and a control end to be coupled back to the first and second cams. The shooting bow with transitional module (shooting bow) preferably includes two string cams, two cables, a bow string, two limbs and a bow riser. The bow riser is enjoined with a barrel for crossbows. One end of the first limb extends from a first end of the bow riser and one end of the second limb extends from a second end of the bow riser. The first cam is pivotally retained on a distal end of the first limb and the second cam is pivotally retained on a distal end of the second limb. A first end of the bowstring is retained by the first cam and a second end of the bowstring is retained by the second cam. A first pulley is pivotally retained on a first side of the barrel. A second pulley is pivotally retained on a second side of the barrel. Alternatively, the first and second pulleys may be attached to a cable hub. The cable hub may be rigidly attached to the barrel or slidably retained on the barrel. The first and second pulleys may also be replaced with first and second semi-circular tracks. Further, the shooting bow may be a vertical shooting bow. A pivot device would be used to pivotally retain the first and second pulleys.

Alternatively, the cable pulleys may be eliminated for the cross bow or the vertical bow by attaching the power end of the first cable to the first cam and the control end to the second cam. The power end of the second cable is attached to the second cam and the control end is attached to the first cam.

The first cam includes a first cam ring, a first cam hub, a first transition module and a first cable post. The first cam hub extends from a bottom of the first cam ring. The first transition module extends downward from the first cam ring and the first transition module is located adjacent the first cam hub. The first cable post extends downward from the first cam ring and the first cable post is adjacent the first transition module. A first string track is formed in a perimeter of the first cam ring. A first cable track is formed in the first cable hub. A first cable track includes a first initial engagement segment, a first angled segment, a first control bypass segment and a first transition segment. A first control cable track is formed in the first cam hub, above the first control bypass segment. A first transition module track is formed in a perimeter of the first transitional module.

The second cam includes a second cam ring, a second cable hub, a second transition module and a second cable post. The second cam hub extends from a bottom of the second cam ring. The second transition module extends downward from the second cam ring and the second transition module is located adjacent the second cam hub. The second cable post extends downward from the second cam ring and the second cable post is adjacent the second transition module. A second string track is formed in a perimeter of the second cam ring. A second cable track is formed in the second cable hub. A second cable track includes a second initial engagement segment, a second angled segment, a second control bypass segment and a second transition segment. A second control cable track is formed in the second cam hub, above the second control bypass segment. A second transition module track is formed in a perimeter of the second transitional module.

A first end (power end) of the first cable is preferably coupled to the first cable post and a portion of the first cable is retained in the first initial engagement segment of the first cam hub track. Substantially a middle of the first cable is retained around the first pulley or the first semi-circular track. A second end (control end) of the first cable is also preferably coupled to the first cable post. A first end (power end) of the second cable is preferably coupled to the second cable post and a portion of the second cable is retained in the second initial engagement segment of the second cam hub track. Substantially a middle of the second cable is retained around the second pulley or the second semi-circular track. A second end (control end) of the second cable is also preferably coupled to the second cable post. Applicant is defining the word coupled as a way of connecting an end of a bowstring or cable to another object. The attachment can be direct or indirect as through another object.

Accordingly, there is a clearly felt need in the art for a shooting bow with transitional module, which allows a power end of first and second cables to be coupled to first and second cams and a control end of the cable to be coupled back to the first and second cams, which in turn allows the cams to rotate as much as 330 degrees.

These and additional objects, advantages, features and benefits of the present invention will become apparent from the following specification.

DETAILED DESCRIPTION OF THE PREFERRED EMBODIMENTS

Figure 1:
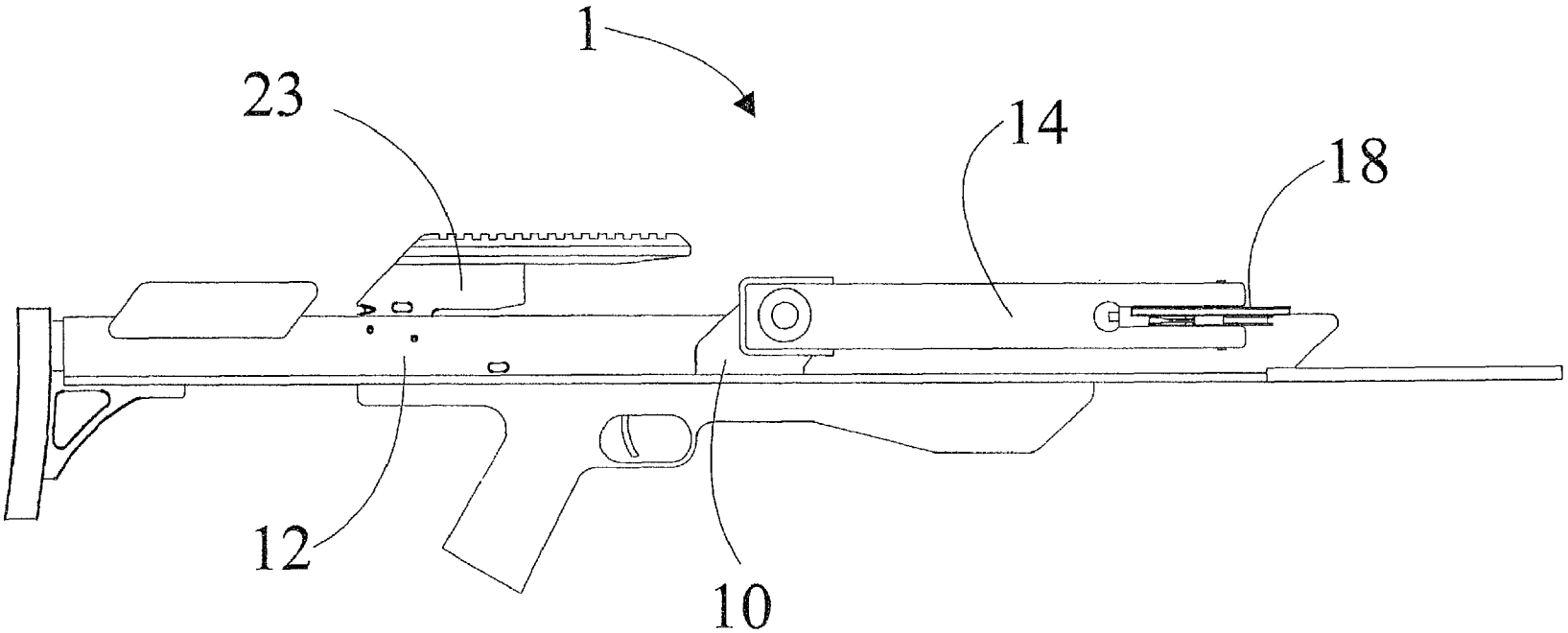
FIG. 1 is a side view of a reverse limb crossbow illustrating a stock, a string latch housing and a bow assembly in accordance with the present invention.
Figure 2:
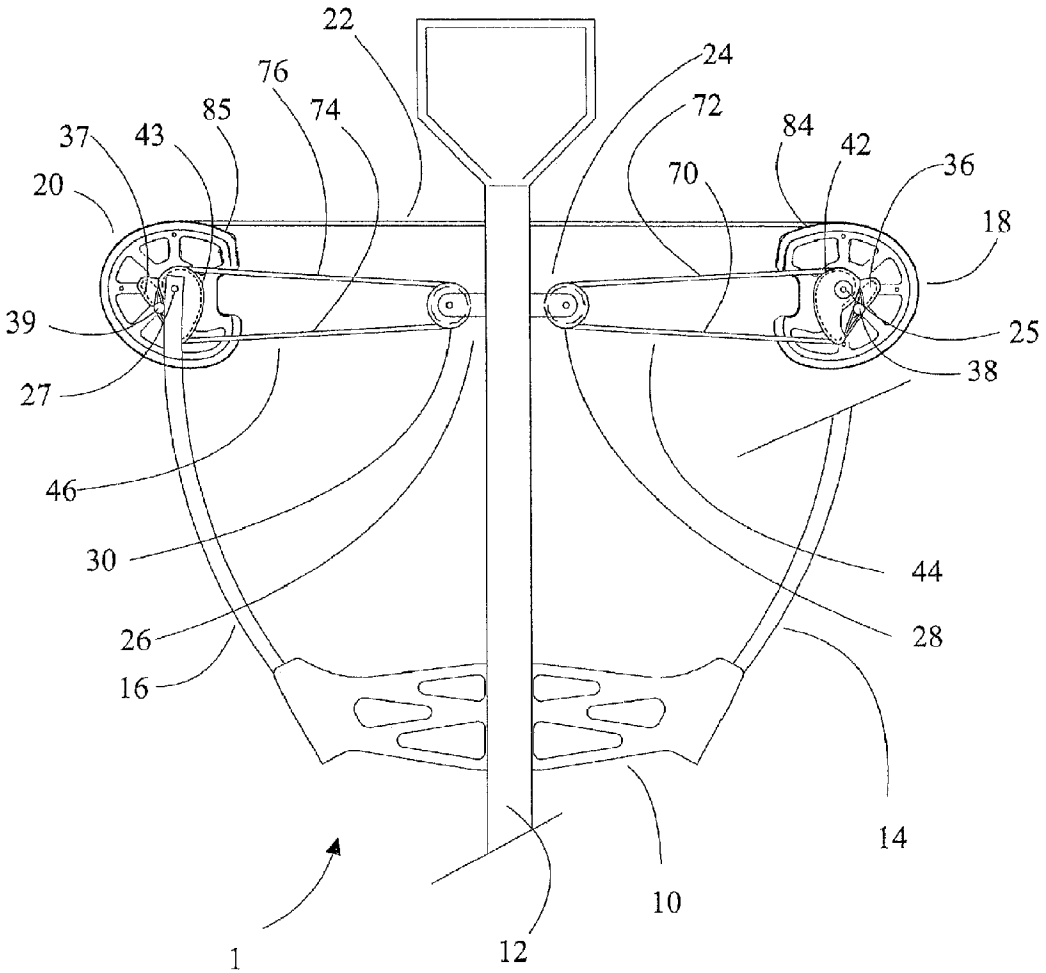
FIG. 2 is a bottom view of a reverse limb crossbow with a bowstring, a first bow limb, a second bow limb and with a bow assembly in an un-drawn position in accordance with the present invention.
Figure 2A:
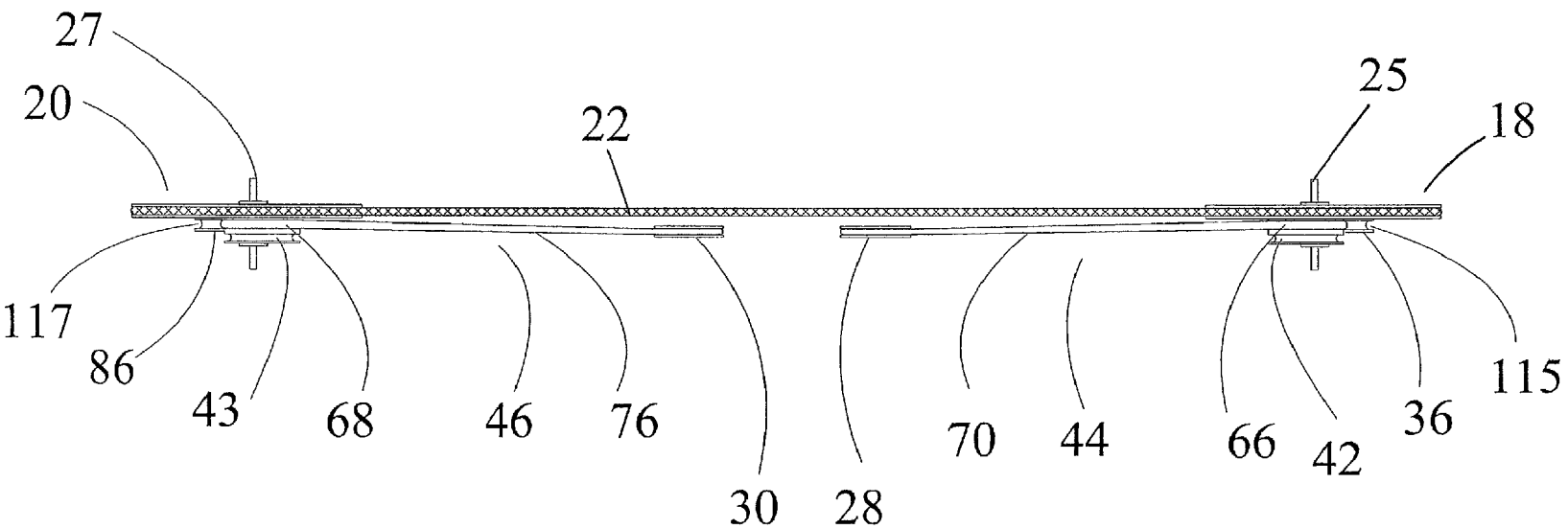
FIG. 2*a* is a front view of first and second cams retaining first and second cables; and a bowstring in an un-drawn position of a reverse limb cross bow in accordance with the present invention.

With reference now to the drawings, and particularly to FIG. 1, there is shown a side view of a reverse limb crossbow 1. With reference to FIGS. 2-4*a*, the reverse limb crossbow 1 preferably includes a bow riser 10, a barrel 12, a first limb 14, a second limb 16, a first cam 18, a second cam 20, at least one bowstring 22 and a string latch housing 23. The bow riser 10 is enjoined with the barrel 12 with any suitable method. The bow riser 10 and barrel 12 may also be formed as a single unit. One end of the first limb 14 extends from a first end of the bow riser 10 and one end of the second limb 16 extends from a second end of the bow riser 10. A first axle 25 pivotally retains the first cam 18 in a distal end of the first limb 14. A second axle 27 pivotally retains the second cam 20 in a distal end of the second limb 16. With references to FIGS. 7-8, a first end of the bowstring 22 is retained on the first cam 18 with a first string post 29 and a second end of the bowstring 22 is retained on the second cam 20 with a second string post 31. A cable hub 24 includes a cable hub body 26, a first pulley 28 and a second pulley 30. The first pulley 28 is rotatably retained on a first side of the cable hub body 26 and the second pulley 30 is rotatably retained on a second side of the cable hub body 26. The cable hub body 26 is attached to the barrel 12. The cable hub 26 may be rigidly attached to the barrel 12 or slidably retained on the barrel 12. The first and second pulleys may also be replaced with first and second semi-circular tracks.

Figure 5:
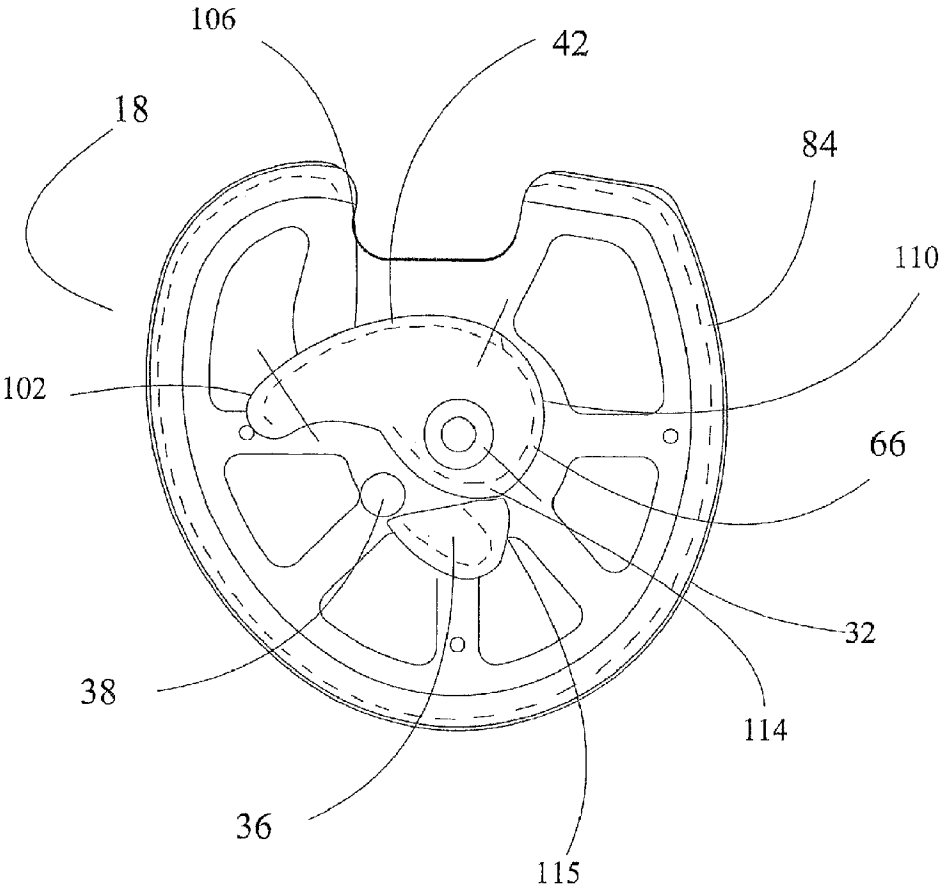
FIG. 5 is a bottom view of a first cam of a reverse limb crossbow in accordance of the present invention.
Figure 7:
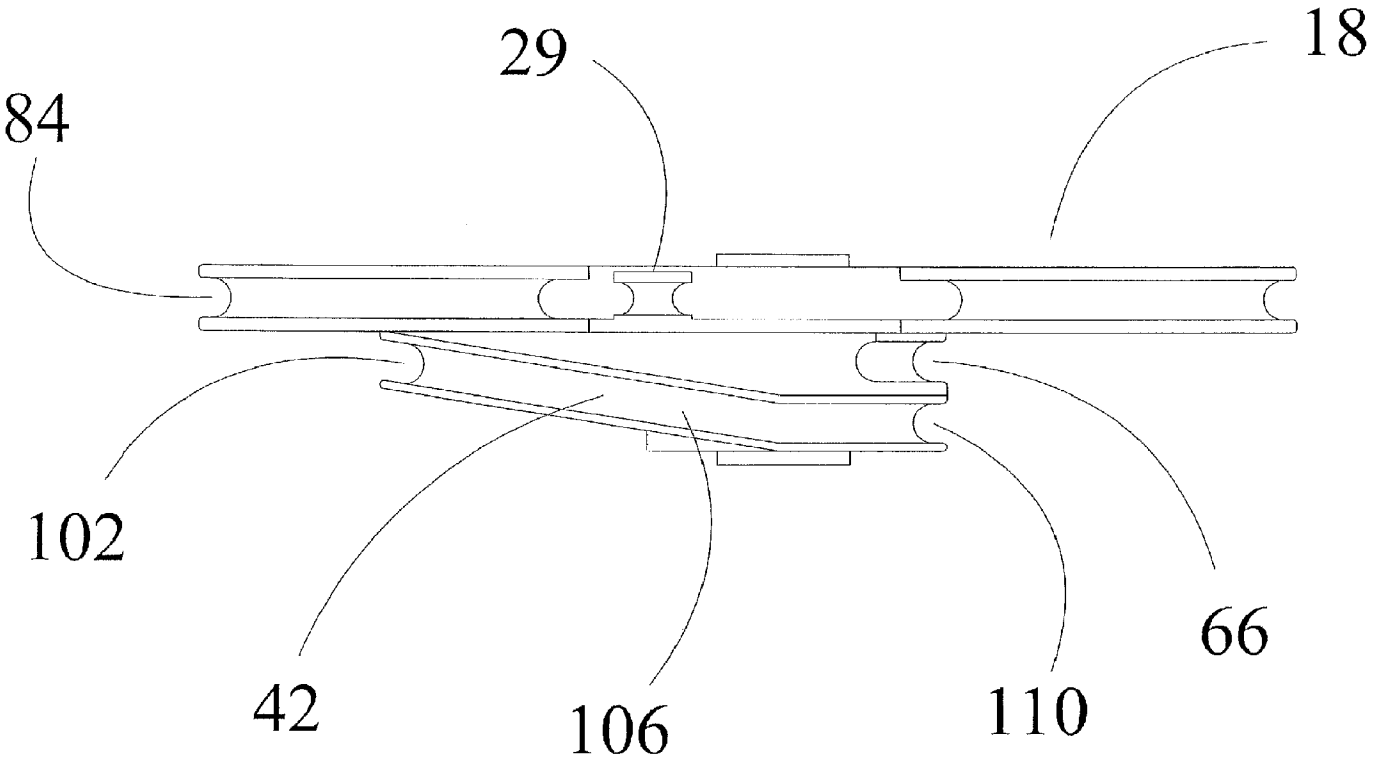
FIG. 7 is a front view of a first cam of a reverse limb crossbow in accordance with the present invention.
Figure 9:
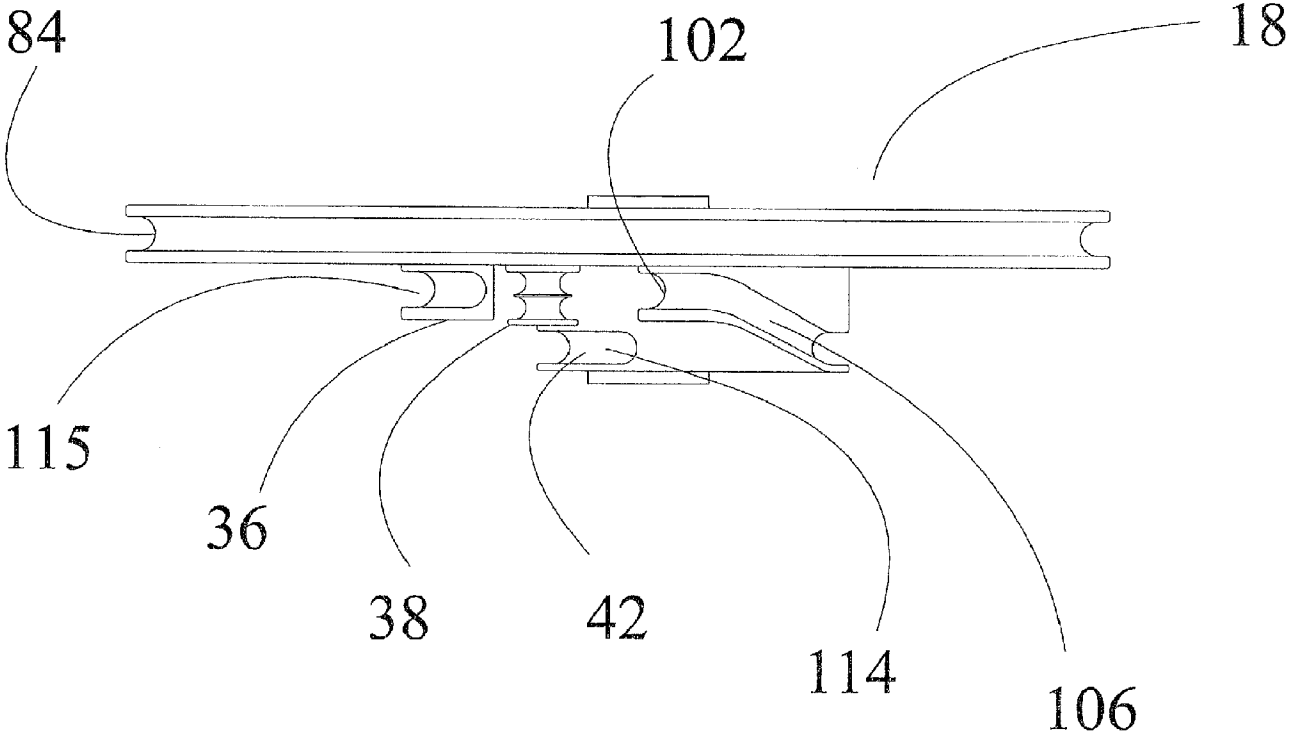
FIG. 9 is a rear view of a first cam of a reverse limb crossbow in accordance with the present invention.

With reference to FIGS. 5, 7 and 9, the first cam 18 includes a first cam ring 32, a first cam hub 34, a first transition module 36 and a first cable post 38. The first cam hub 34 extends from a bottom of the first cam ring 32. The first transition module 36 extends from a bottom of the first cam ring 32 and the first transition module 36 is located adjacent the first cam hub 34. The first cable post 38 extends from a bottom of the first cam ring 32 and the first cable post 38 is located adjacent to the first transition module 36. A first string track 84 is formed in a perimeter of the first cam ring 32. A first cable track 42 is formed in the first cam hub 34. The first cable track 42 includes a first initial engagement segment 102, a first angled segment 106, a first control bypass segment 110 and a first transition segment 114. A first transition module track 115 is formed in a perimeter of the first transitional module 36. The first cable track 42 includes an upper track level, which continues into a lower track level. The first initial engagement segment 102 is located on the upper track level and the first transition segment 114 is located on the lower track level. A first control cable track 66 is formed in the first cam hub 34, above the first control bypass segment 110 and inline with the first initial engagement segment 102. The first transition module track 115 is located inline with the first initial engagement segment 102.

Figure 6:
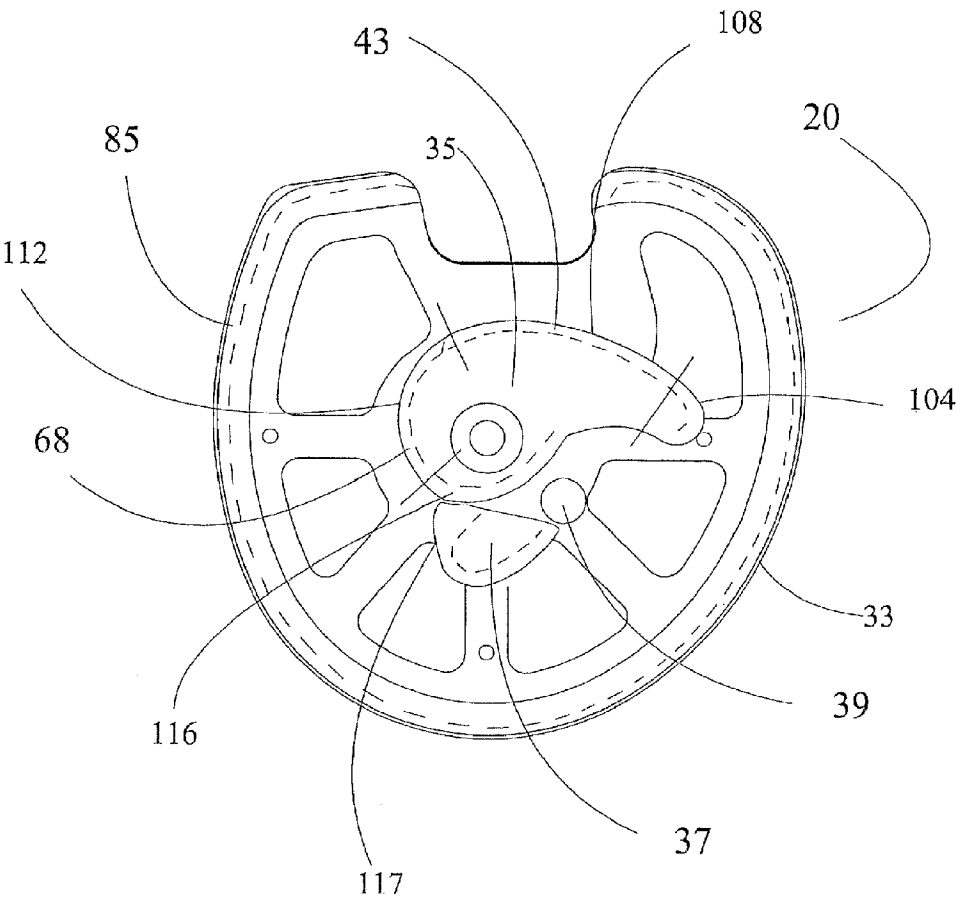
FIG. 6 is a bottom view of a second cam of a reverse limb crossbow in accordance of the present invention.
Figure 8:
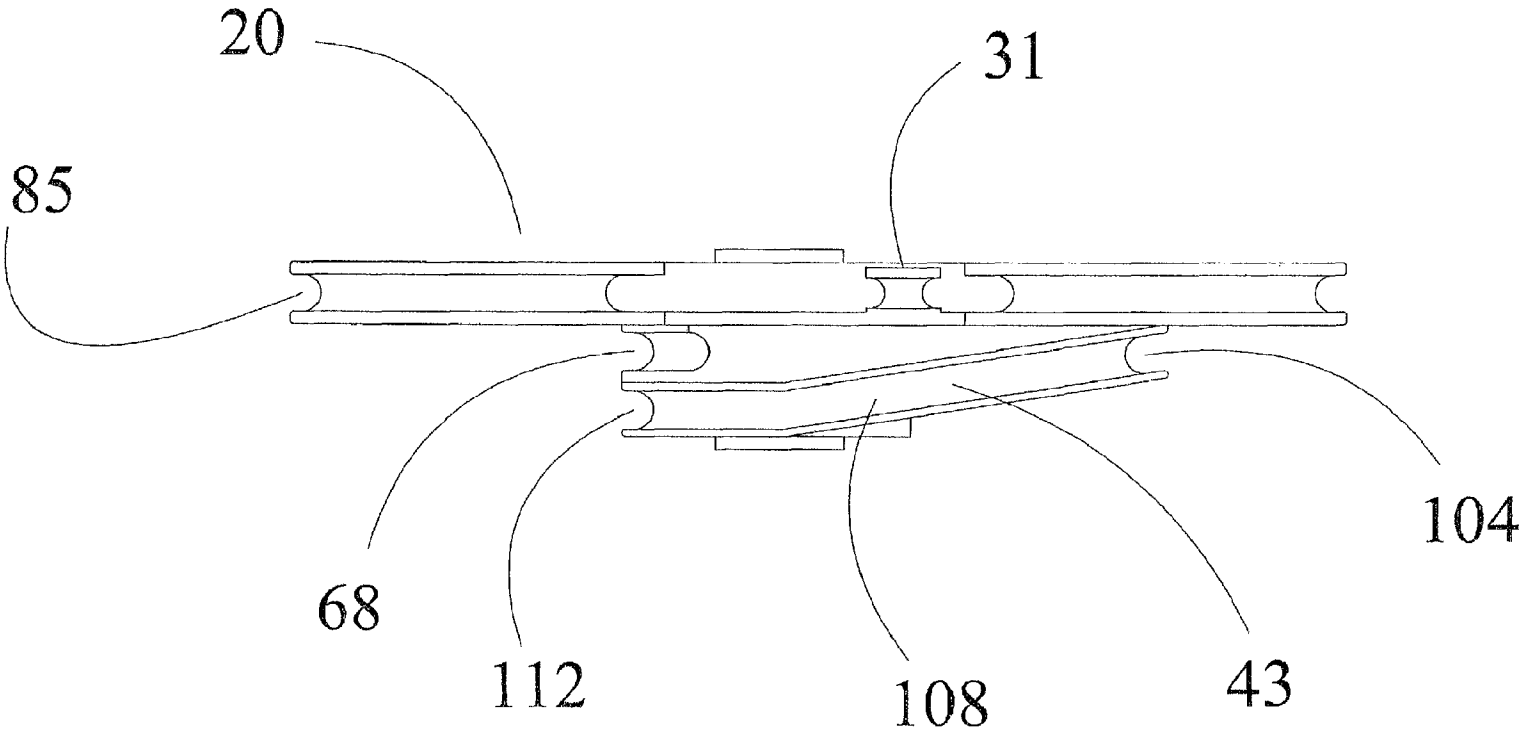
FIG. 8 is a front view of a second cam of a reverse limb crossbow in accordance with the present invention.
Figure 10:
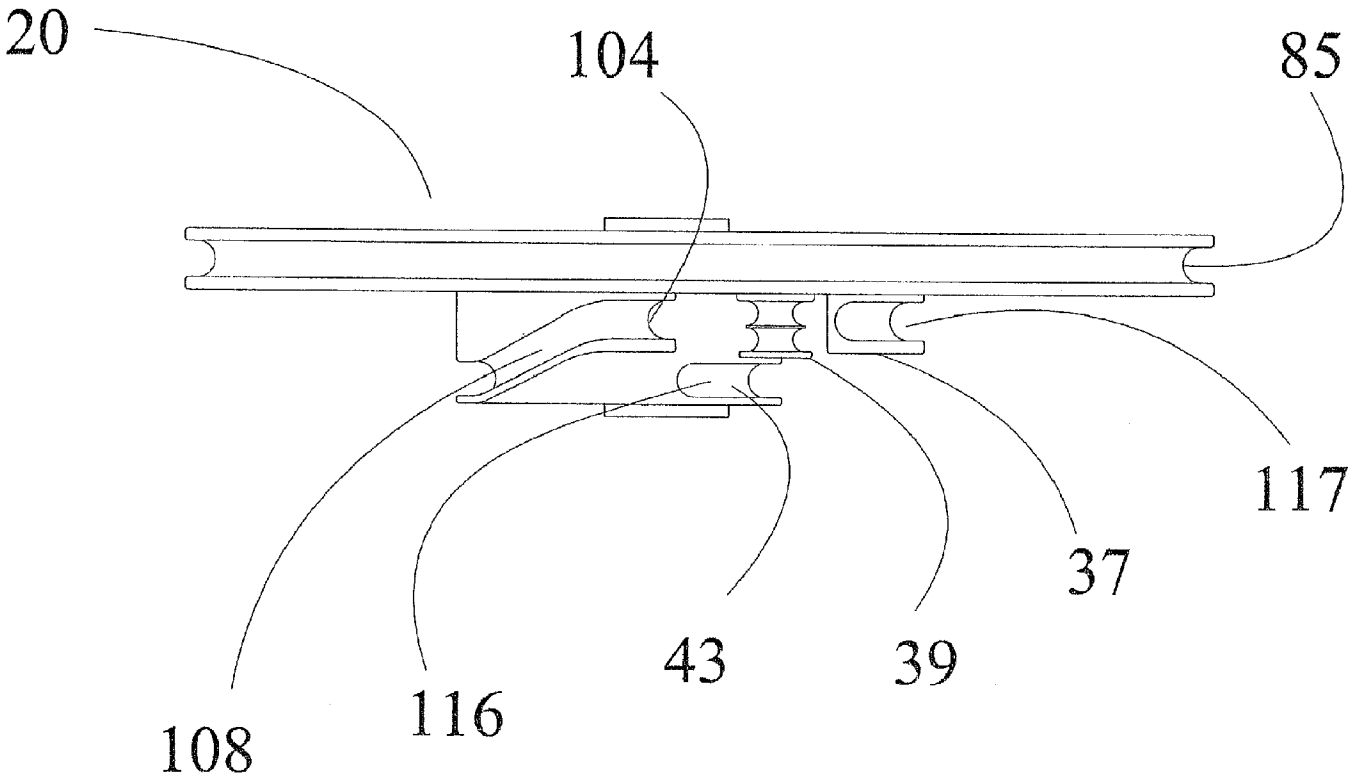
FIG. 10 is a rear view of a second cam of a reverse limb crossbow in accordance with the present invention.
Figure 11:
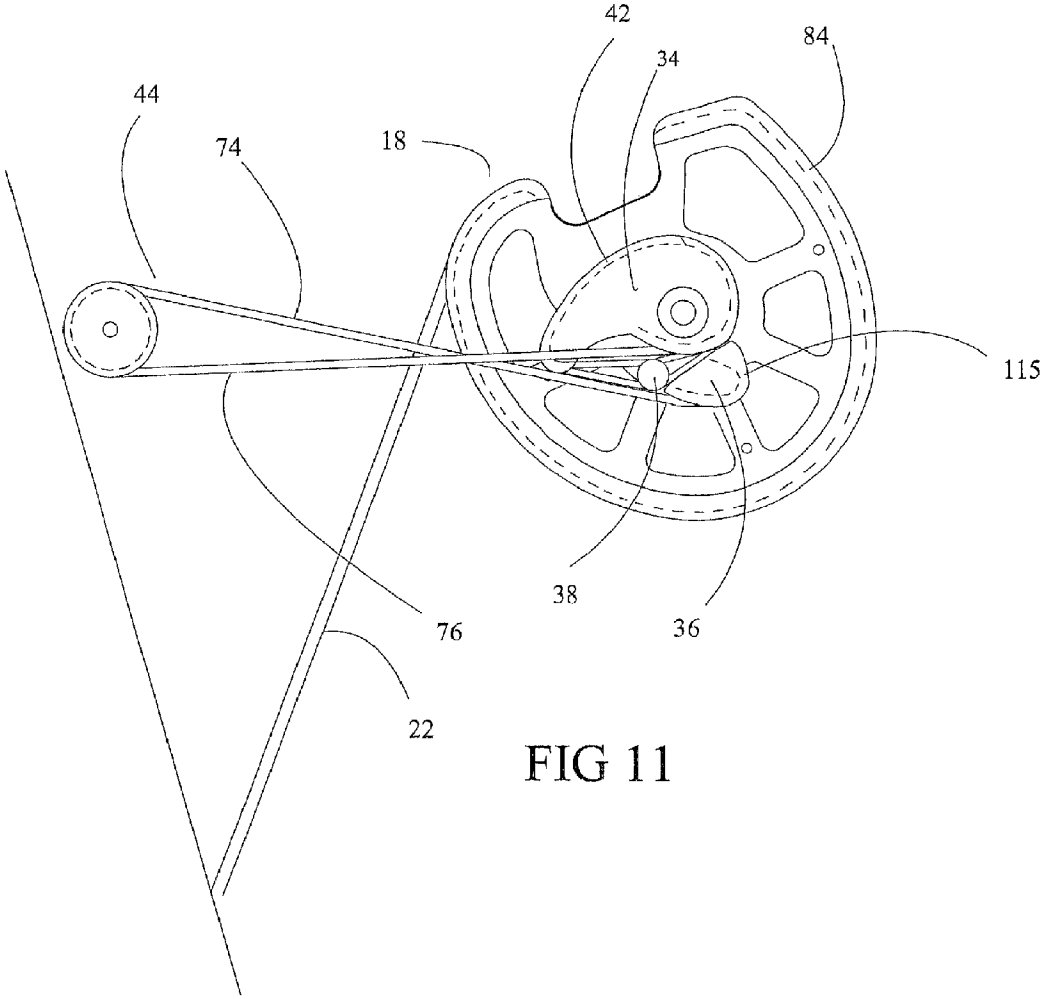
FIG. 11 is a bottom view of a first cam of a reverse limb crossbow with a bowstring cocked, illustrating full rotation of the first cam in accordance with the present invention.
Figure 12:
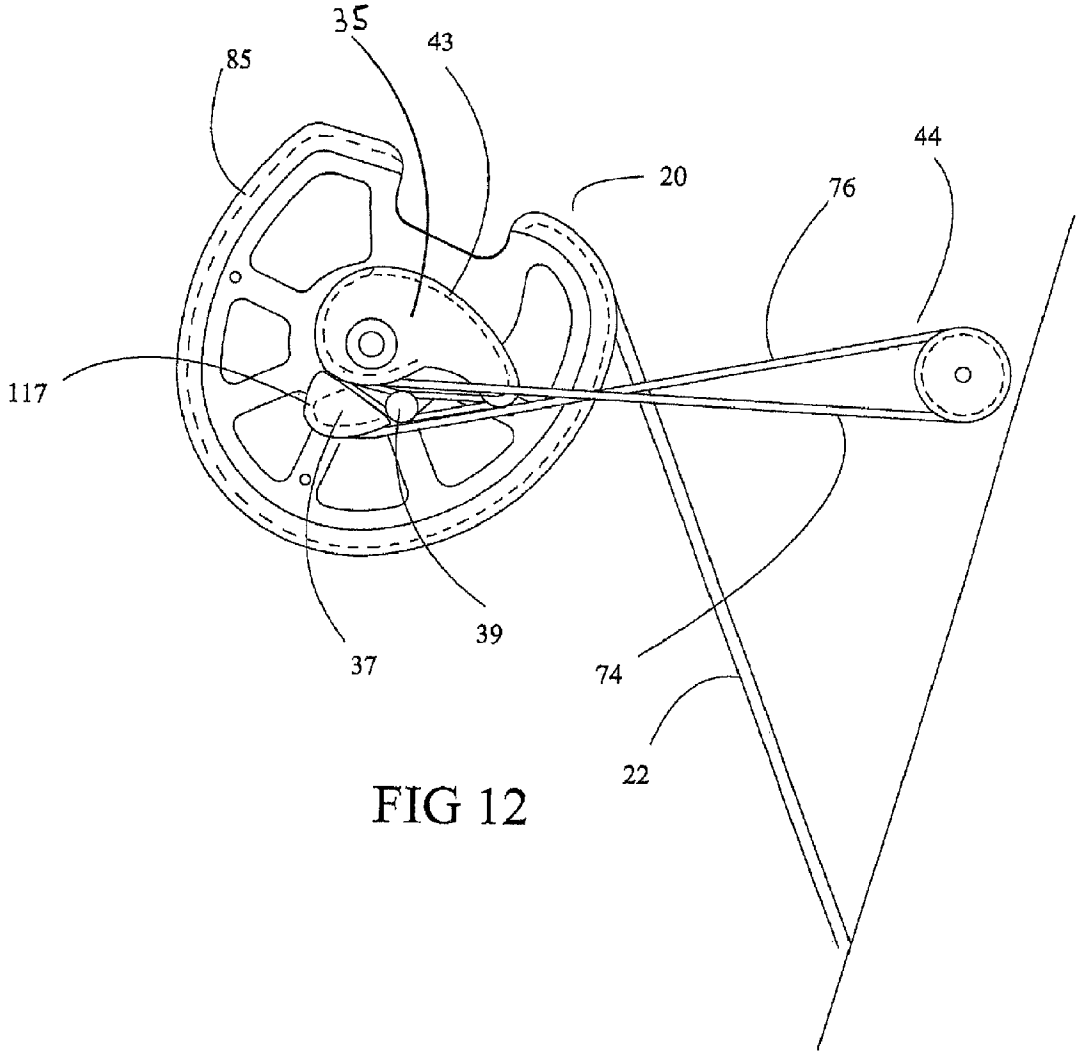
FIG. 12 is a bottom view of a second cam of a reverse limb crossbow with a bowstring cocked, illustrating full rotation of the first cam in accordance with the present invention.

With reference to FIGS. 6, 8 and 10, the second cam 20 includes a second cam ring 33, a second cam hub 35, a second transition module 37 and a second cable post 39. The second cam hub 35 extends from a bottom of the second cam ring 33. The first and second cam hubs 34, 35 have a substantial coma shape. The second transition module 37 extends from a bottom of the second cam ring 33 and the second transition module 37 is located adjacent the second cam hub 35. The second cable post 39 extends from a bottom of the second cam ring 33 and the second cable post 39 is located adjacent to the second transition module 37. The first and second cable posts both include upper and lower cable grooves. A second string track 85 is formed in a perimeter of the second cam ring 33. A second cable track 43 is formed in the second cam hub 35. The second cable track 43 includes a second initial engagement segment 104, a second angled segment 108, a second control bypass segment 112 and a second transition segment 116. A second transition module track 117 is formed in a perimeter of the second transitional module 37. The second cable track 43 includes an upper level, which continues into a lower level. The second initial engagement segment 104 is located on the upper track level and the second transition segment 116 is located on the lower track level. A second control cable track 68 is formed in the second cam hub 35, above the second control bypass segment 112 and inline with the first initial engagement segment 104. The second transition module track 117 is inline with the second initial engagement segment 104.

A portion of the first cable 44 between a first end and the first pulley 28 is known as a first power section 70. A portion of the first cable 44 between the first pulley 28 and a second end is known as a first control section 72. The first end of the first cable 44 is coupled to the first cable post 38. The first power section 70 is retained in the first initial engagement segment 102, when the string is not cocked. Substantially a middle of the first cable 44 is retained around the first pulley 28. The first control section 72 is partially retained by the first control cable track 66 and coupled to the first cable post 38.

A portion of the second cable 46 between a first end and the second pulley 30 is known as a second power section 74. A portion of the second cable 46 between the second pulley 30 and a second end is known as a second control section 76. The first end of the second cable 46 is coupled to the second cable post 39. The second power section 74 is retained in the second initial engagement segment 104 of the second cable track 44, when the string is not cocked. Substantially a middle of the second cable 46 is retained around the second pulley 30. The second control section 76 is partially retained by the second control cable track 68.

Figure 3:
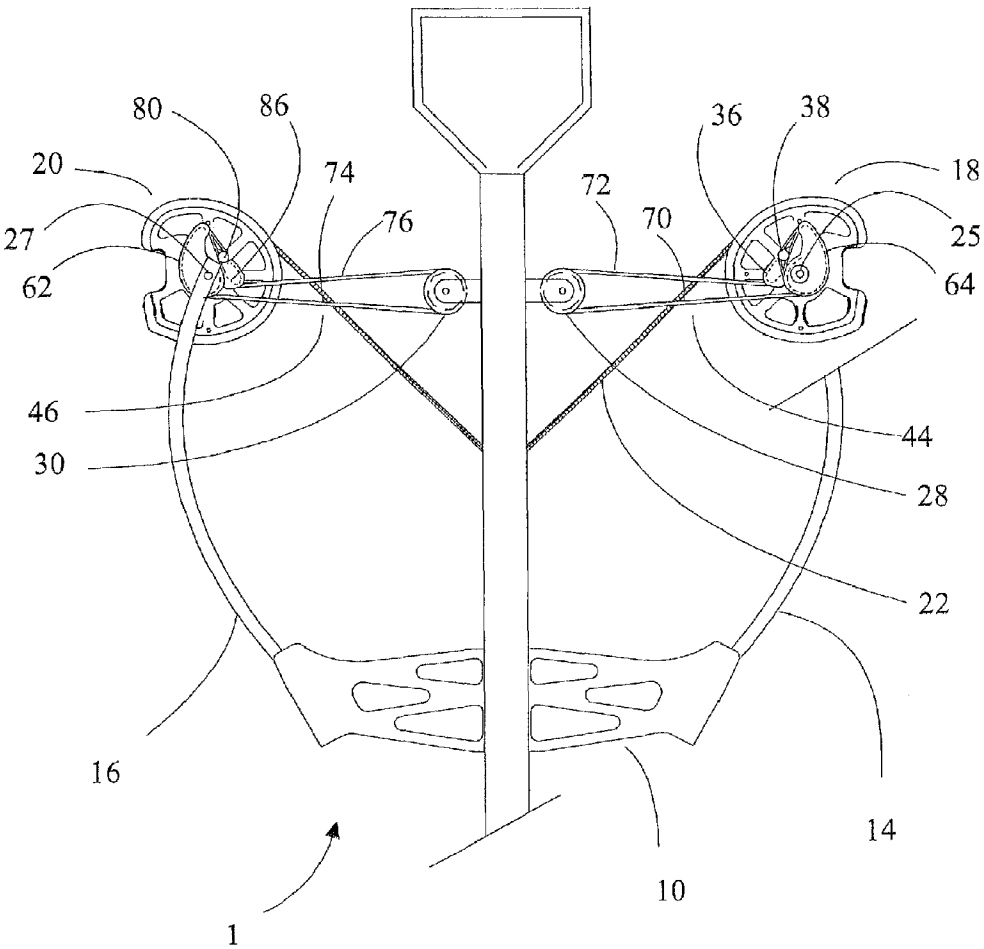
FIG. 3 is a bottom view of a reverse limb crossbow with the bow assembly shown in a partially cocked position in accordance with the present invention.
Figure 3A:
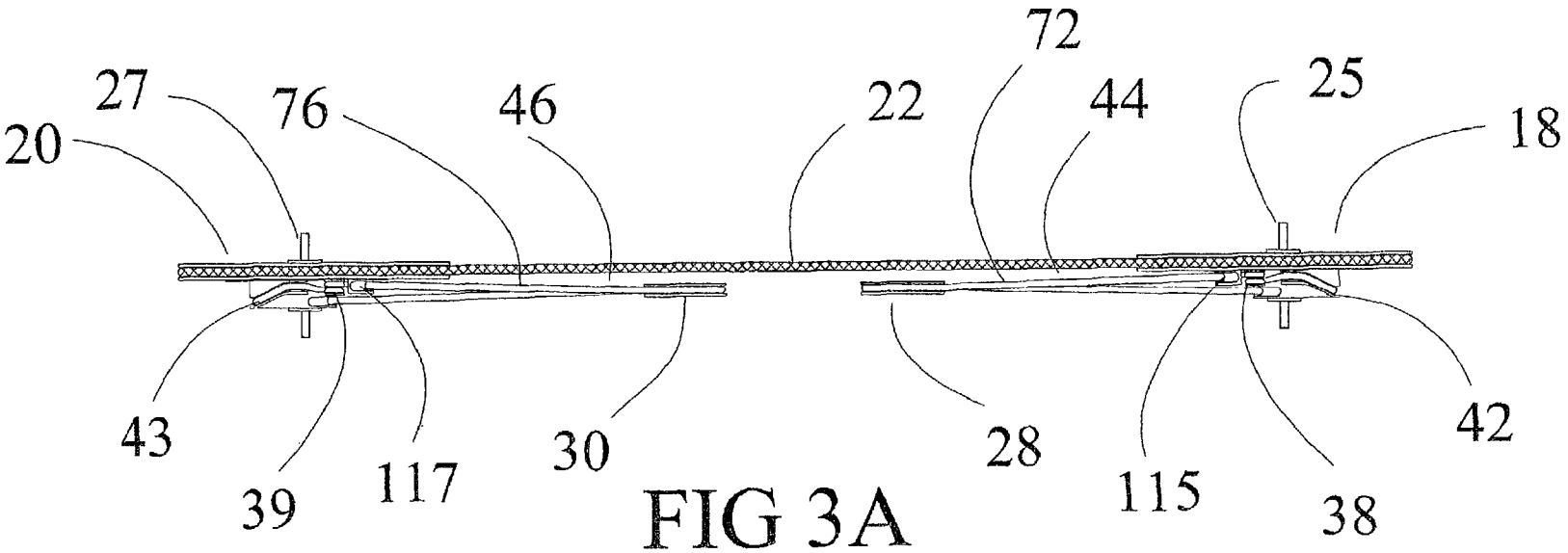
FIG. 3*a* is a front view of first and second cams retaining first and second cables and a bowstring in a partially cocked position of a reverse limb crossbow in accordance with the present invention.

With reference to FIG. 3, as the bowstring 22 is pulled into a cocked position, the limbs 14 and 16 deflect as the cams 18 and 20 rotate upon the axles 25 and 27. As the cams 18 and 20 start to rotate, the first and second cables 44, 46 are wrapped into angled segments 106, 108 and control bypass segments 110, 112. As the power sections 70, 74 are wrapped; the control sections 72, 76 are unwrapped from the cable tracks 42, 43 at a lesser rate than the power segments 70, 74. At a determined degree of rotation of the cams 18 and 20, the rate of wrapping of the power sections 70, 74 of the cables 44, 46 will equal the rate of unwrapping of the control sections 72, 76 of the cables 44 and 46. As the cams 18, 20 continue to rotate the control sections 72, 76 will transition from the cable tracks 42, 43 into the transition module tracks 115, 117.

Figure 4:
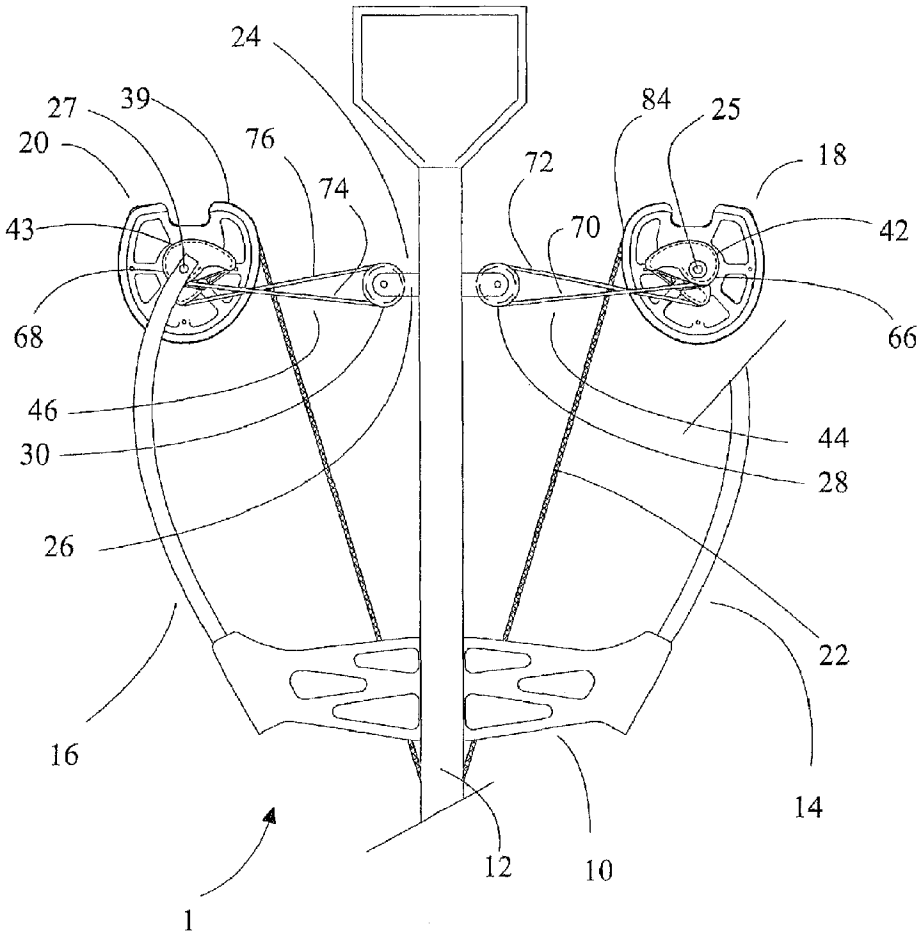
FIG. 4 is a bottom view of a reverse limb crossbow with the bow assembly shown in a nearly fully cocked position in accordance with the present invention.
Figure 4A:
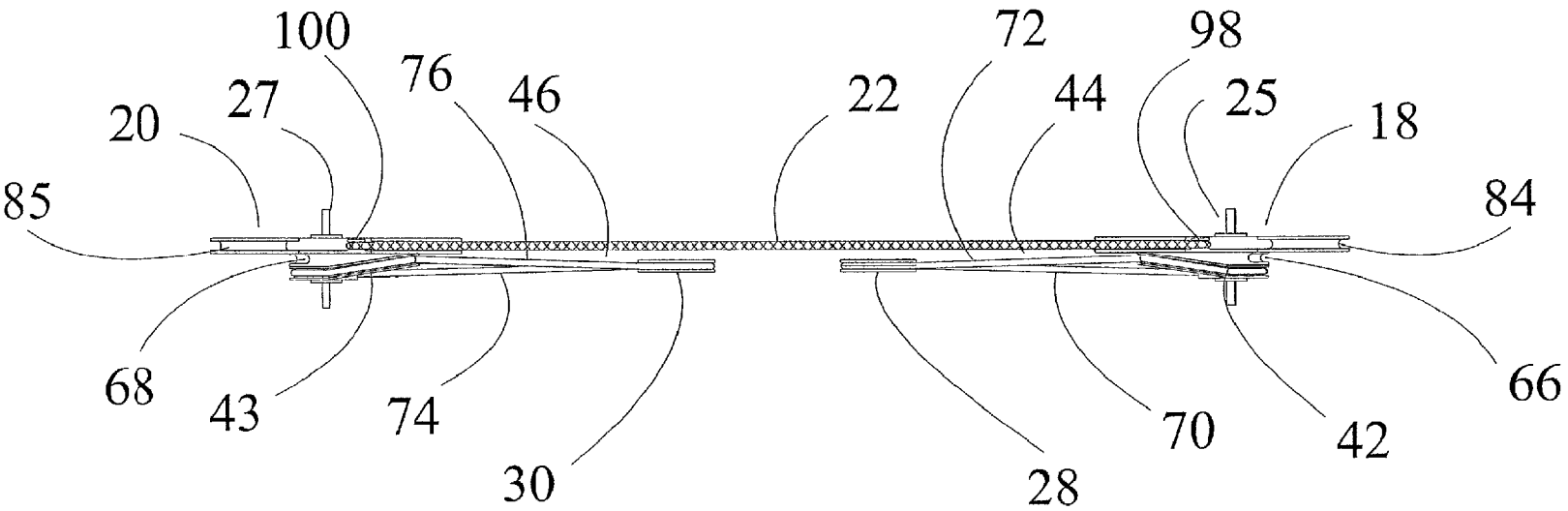
FIG. 4*a* is a front view of first and second cams retaining first and second cables and a bowstring in a nearly fully cocked position of a reverse limb crossbow in accordance with the present invention.

Once the control sections 72, 76 enter the transition module tracks 115, 117, the control sections 72, 76 become power sections, similar to sections 70, 74. With reference to FIG. 4, as the cams 18, 20 approach full rotation, the power sections 70, 74 cross over the control sections 72, 76. The transition modules 36, 37 allow the cams 18, 20 to rotate as much as 330 degrees.

Figure 13:
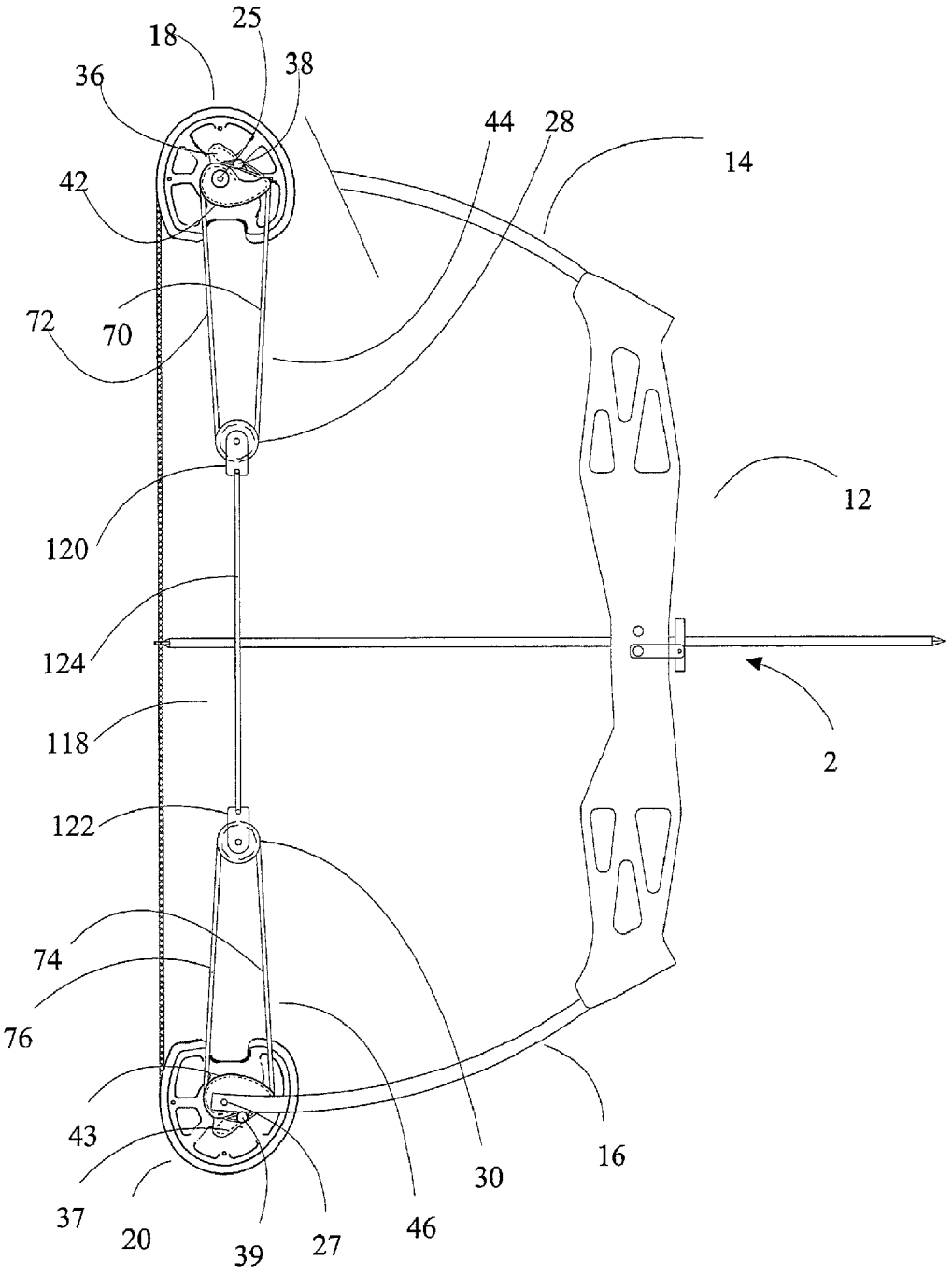
FIG. 13 is a side view of a vertical bow with a transitional module of the present invention.

With reference to FIG. 13, the cams 18, 20, the cables 44, 46 and the pulleys 28, 30 may be utilized on a vertical shooting bow 2. The vertical shooting bow includes the bow riser 12, the first limb 14 and the second limb 16. A pivot device 118 is used to connect the first pulley 28 to the second pulley 30. The pivot device 118 includes a first bracket 120, a second bracket 122 and a cable 124. The first pulley 28 is pivotally retained in the first bracket 120 and the second pulley 30 is pivotally retained in the second bracket 122. The first bracket 120 is secured to a first end of the cable 124 and the second bracket 122 is secured to a second end of the cable 124. The transition modules 36, 37 will allow the cams 18, 20 to rotate as much as 330 degrees. Consequently, the cams 18, 20 will rotate 190, 200, 210, 220, 230, 240, 250, 260, 270, 280, 290, 300, 310, 320 or 330 degrees, when the bowstring 22 is cocked.

Figure 14:
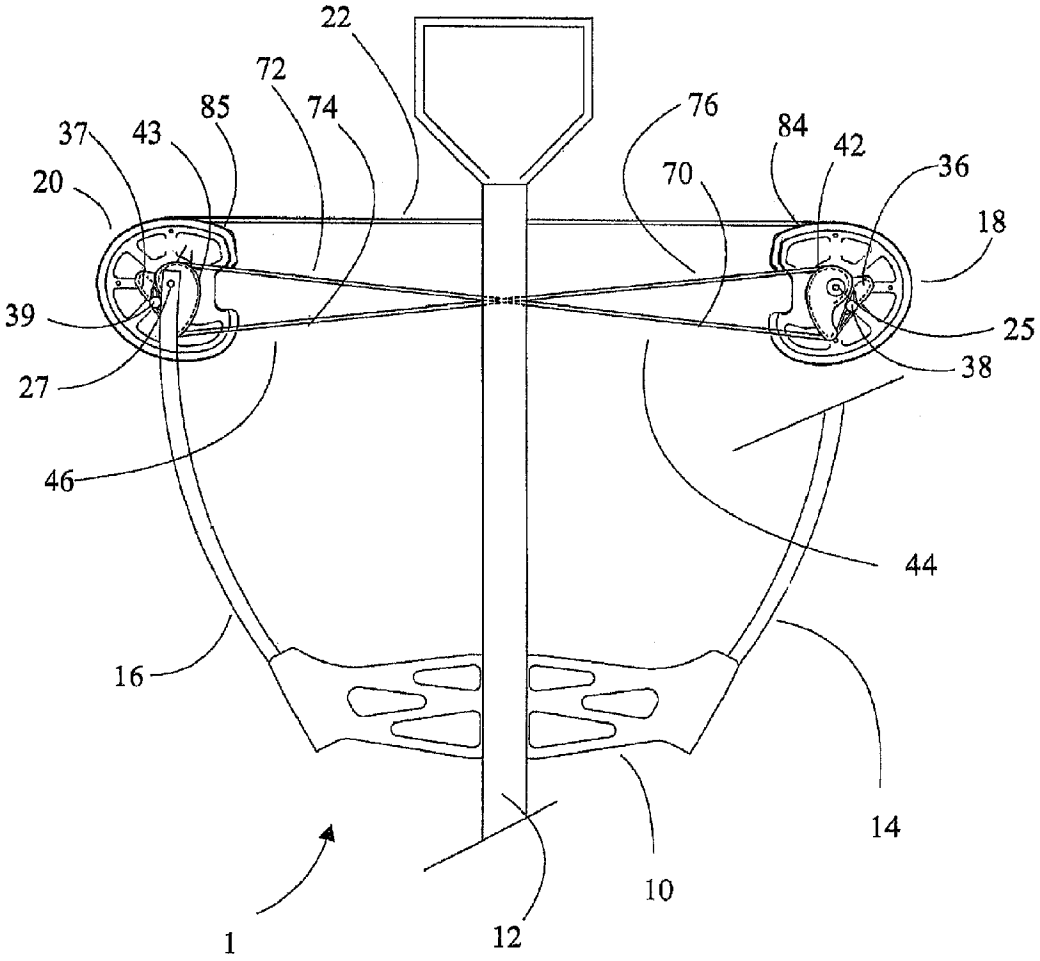
FIG. 14 is a side view of a crossbow with a transitional module and a cable arrangement without pulleys of the present invention.
Figure 15:
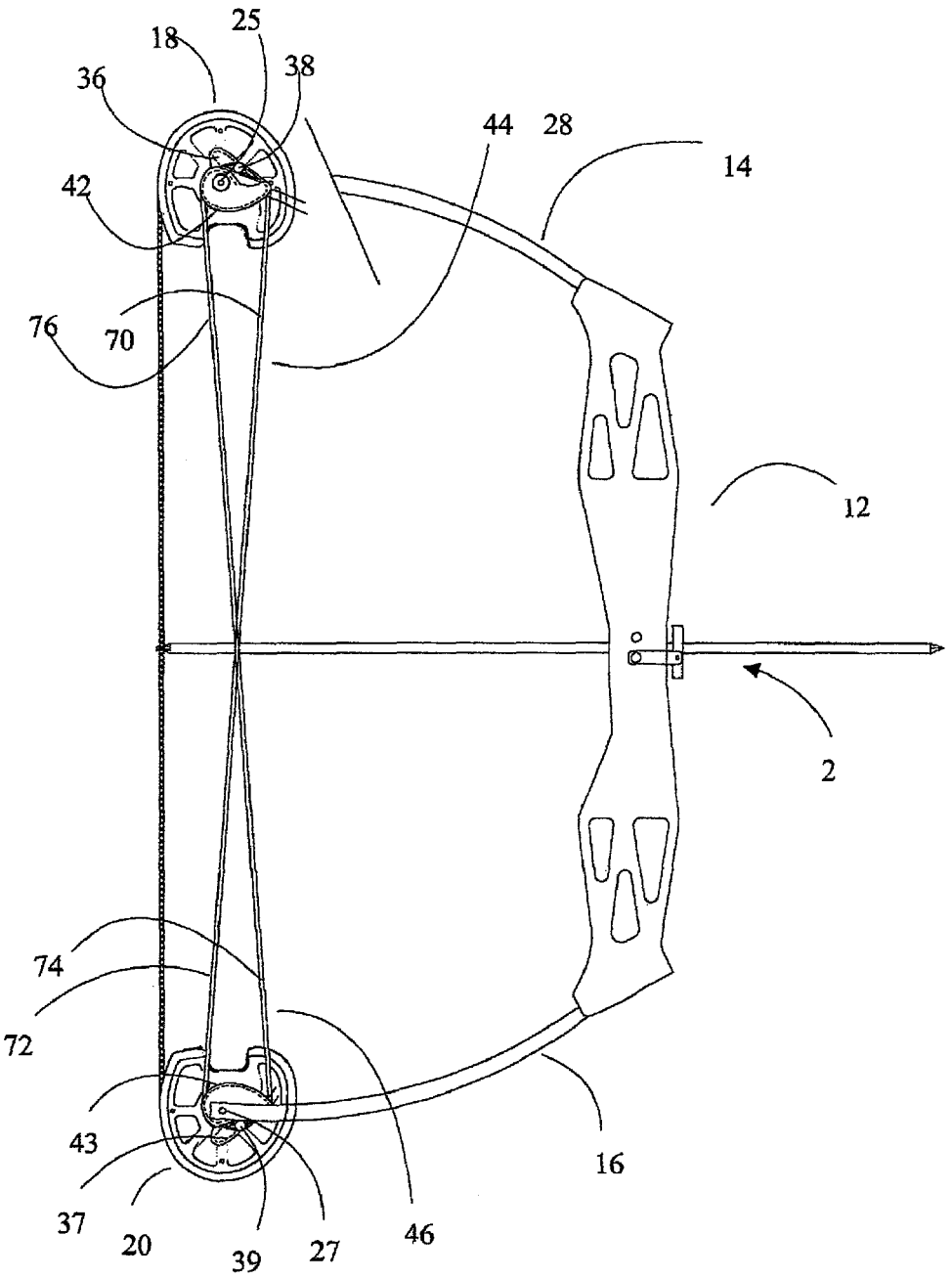
FIG. 15 is a side view of a vertical bow with a transitional module and a cable arrangement without pulleys of the present invention.

With reference to FIGS. 14-15, the cable pulleys 28, 30 may be eliminated for the crossbow 1 or the vertical bow 2. The power end of the first cable 44 is attached to the first cable post 38 of the first cam 18 and the control end to the second cable post 39 of the second cam 20. The power end of the second cable 46 is attached to the second cable post 39 of the second cam 20 and the control end is attached to the first cable post 38 of the first cam 18.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A shooting bow with transition modules comprising:

a bow riser having a first end and a second end;

a first limb extends from said first end of said bow riser;

a second limb extends from said second end of said bow riser;

a first cam having a first cam ring, a first cam hub and a first transition module, said first cam is pivotally retained on a distal end of said first limb, wherein said first cam hub includes a first cable track, a second cable track and a first transition track segment, said first cable track and said second cable track are substantially parallel to said first cam ring, said first cable track is located between said first cam ring and said second cable track, one end of said first transition track segment communicates with said first cable track, an opposing end of said first transition track segment communicates with said second cable track;

a second cam having a second cam ring, a second cam hub and a second transition module, said second cam is pivotally retained on a distal end of said second limb, wherein said second cam hub includes a third cable track, a fourth cable track and a second transition track segment, said third cable track and said fourth cable track are substantially parallel to said second cam ring, said third cable track is located between said second cam ring and said fourth cable track, one end of said second transition track segment communicates with said third cable track, an opposing end of said transition track segment communicates with said fourth cable track;

a bow string is retained by said first and second cam rings;

a first cable having each end coupled to said first cam, said first cable is retained by said first cable hub; and a second cable having each end coupled to said second cam, said second cable is retained by said second cable hub, wherein said first cable is in contact with said first transition module and said first cam hub when said bow string is cocked, said second cable is in contact with said second transition module and said second cam hub when said bow string is cocked.

2. The shooting bow with transition modules of claim 1 wherein:

said first and second cams rotating at least one of 190, 200, 210, 220, 230, 240, 250, 260, 270, 280, 290, 300, 310, 320 and 330 degrees.

3. The shooting bow with transition modules of claim 1, further comprising:

substantially said middle of said first cable is retained relative to substantially a middle of said second cable with one of a first pulley and a first semi-circular slide, substantially said middle of said second cable is retained relative to substantially a middle of said first cable with one of a second pulley and a second semi-circular slide.

4. The shooting bow with transition modules of claim 1 wherein:

said first transition module includes a first transition track, said second transition module includes a second transition track.

5. The shooting bow with transition modules of claim 1 wherein:

said shooting bow is one of a cross bow and a vertical bow.

6. The shooting bow with transition modules of claim 1, further comprising:

a string latch housing is retained on a barrel of said cross bow to cock said bow string.

7. A shooting bow with transition modules comprising:

a bow riser having a first end and a second end;

a first limb extends from said first end of said bow riser;

a second limb extends from said second end of said bow riser;

a first cam having a first cam ring, a first cam hub and a first transition module, said first cam is pivotally retained on a distal end of said first limb, wherein said first cam hub includes a first cable track, a second cable track and a first transition track segment, said first cable track and said second cable track are substantially parallel to said first cam ring, said first cable track is located between said first cam ring and said second cable track, one end of said first transition track segment communicates with said first cable track, an opposing end of said first transition track segment communicates with said second cable track;

a second cam having a second cam ring, a second cam hub and a second transition module, said second cam is pivotally retained on a distal end of said second limb, wherein said second cam hub includes a third cable track, a fourth cable track and a second transition track segment, said third cable track and said fourth cable track are substantially parallel to said second cam ring, said third cable track is located between said second cam ring and said fourth cable track, one end of said second transition track segment communicates with said third cable track, an opposing end of said transition track segment communicates with said fourth cable track;

a bow string is retained by said first and second cam rings;

a first cable having each end coupled to said first cam, said first cable is retained by said first cable hub; and a second cable having each end coupled to said second cam, said second cable is retained by said second cable hub, wherein said first cable is in contact with said first transition module and said first cam hub when said bow string is cocked, said second cable is in contact with said second transition module and said second cam hub when said bow string is cocked, wherein said first cable crosses itself and said second cable crosses itself when said bow string is cocked.

8. The shooting bow with transition modules of claim 7 wherein:

said first and second cams rotating at least one of 190, 200, 210, 220, 230, 240, 250, 260, 270, 280, 290, 300, 310, 320 and 330 degrees.

9. The shooting bow with transition modules of claim 7 wherein:

said first transition module includes a first transition track, said second transition module includes a second transition track.

10. The shooting bow with transition modules of claim 7, further comprising:

substantially said middle of said first cable is retained relative to substantially a middle of said second cable with one of a first pulley and a first semi-circular slide, substantially said middle of said second cable is retained relative to substantially a middle of said first cable with one of a second pulley and a second semi-circular slide.

11. The shooting bow with transition modules of claim 7 wherein:

said shooting bow is one of a cross bow and a vertical bow.

12. The shooting bow with transition modules of claim 7, further comprising:

a string latch housing is retained on a barrel of said cross bow to cock said bow string.

13. A shooting bow with transition modules comprising:

a bow riser having a first end and a second end;

a first limb extends from said first end of said bow riser;

a second limb extends from said second end of said bow riser;

a first cam having a first cam ring, a first cam hub and a first transition module, said first cam is pivotally retained on a distal end of said first limb, wherein said first cam hub includes a first cable track, a second cable track and a first transition track segment, said first cable track and said second cable track are substantially parallel to said first cam ring, said first cable track is located between said first cam ring and said second cable track, one end of said first transition track segment communicates with said first cable track, an opposing end of said first transition track segment communicates with said second cable track;

a second cam having a second cam ring, a second cam hub and a second transition module, said second cam is pivotally retained on a distal end of said second limb, wherein said second cam hub includes a third cable track, a fourth cable track and a second transition track segment, said third cable track and said fourth cable track are substantially parallel to said second cam ring, said third cable track is located between said second cam ring and said fourth cable track, one end of said second transition track segment communicates with said third cable track, an opposing end of said transition track segment communicates with said fourth cable track;

a bow string is retained by said first and second cam rings;

a first cable having one end coupled to said first cam and the other end coupled to said second cam, said first cable is retained by said first cable hub; and a second cable having one end coupled to said second cam and the other end coupled to said first cam, said second cable is retained by said second cable hub, wherein said first cable is in contact with one of said first and second transition modules and said first cam hub when said bow string is cocked, said second cable is in contact with one of said second and first transition modules and said second cam hub when said bow string is cocked.

14. The shooting bow with transition modules of claim 13 wherein:

said first and second cams rotating at least one of 190, 200, 210, 220, 230, 240, 250, 260, 270, 280, 290, 300, 310, 320 and 330 degrees.

15. The shooting bow with transition modules of claim 13 wherein:

said first transition module includes a first transition track, said second transition module includes a second transition track.

16. The shooting bow with transition modules of claim 13 wherein:

said shooting bow is one of a cross bow and a vertical bow.

17. The shooting bow with transition modules of claim 13, further comprising:

a string latch housing is retained on a barrel of said cross bow to cock said bow string.

* * * * *